United States Patent [19]

Iwane

[11] 4,426,167

[45] Jan. 17, 1984

[54] SERIAL PRINTER HAVING TWO CARRIAGES CARRYING RESPECTIVE TYPE WHEELS AND MOVABLE INDEPENDENTLY

[75] Inventor: Yasuhiko Iwane, Tamayama, Japan

[73] Assignee: Alps Electric Co., Ltd., Tokyo, Japan

[21] Appl. No.: 348,144

[22] Filed: Feb. 11, 1982

[30] Foreign Application Priority Data

Feb. 17, 1981 [JP] Japan ..... 56-21918

[51] Int. Cl.[3] ..... B41J 11/18; B41J 1/32

[52] U.S. Cl. ..... 400/159; 400/171; 101/93.17

[58] Field of Search ..... 101/93.15, 93.16, 93.17, 101/110; 400/171, 314.6, 328, 328.1, 471, 159

[56] References Cited

U.S. PATENT DOCUMENTS

| | | | |
|---|---|---|---|
| 4,051,942 | 10/1977 | Suzuki et al. | 101/93.16 X |
| 4,244,291 | 1/1981 | Kodaira et al. | 101/99 |
| 4,310,256 | 1/1982 | Inoue | 101/93.17 X |
| 4,337,697 | 7/1982 | Aoki et al. | 101/93.17 X |
| 4,352,576 | 10/1982 | Hori et al. | 101/93.17 X |

FOREIGN PATENT DOCUMENTS 2056918 4/1981 United Kingdom .

OTHER PUBLICATIONS

IBM Technical Disclosure Bulletin "High Speed Printer" by Pawletko et al., vol. 19, No. 9, Feb. 1977, pp. 3355–3356.

*Primary Examiner*—Edgar S. Burr
*Assistant Examiner*—John A. Weresh
*Attorney, Agent, or Firm*—Guy W. Shoup; Gerard F. Dunne

[57] ABSTRACT

A serial printer of the type having a carriage carrying a type head and adapted to be column-shifted by a cooperation between a rack and a screw member. The printer comprises a rotary shaft adapted to be driven by a suitable power source, a first and second screw members splined to the rotary shaft, a first and second carriages carrying the first and second screw members, the first and second carriages having home positions defined at both ends of the column-shift, spiral screws formed on the first and second screw members and orientated in the opposite directions, and a rack member having short racks formed on both ends thereof and an intermediate long rack, the long rack being engageable selectively with the first and second screw members by a selection of rotational positions of the two short racks.

9 Claims, 17 Drawing Figures

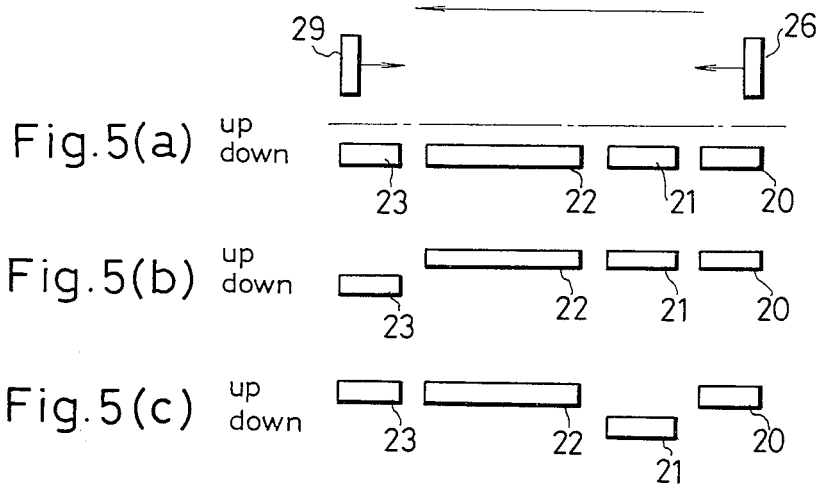
29
26
Fig.5(a)
up
down
23
22
21
20
Fig.5(b)
up
down
23
22
21
20
Fig.5(c)
up
down
23
22
21
20
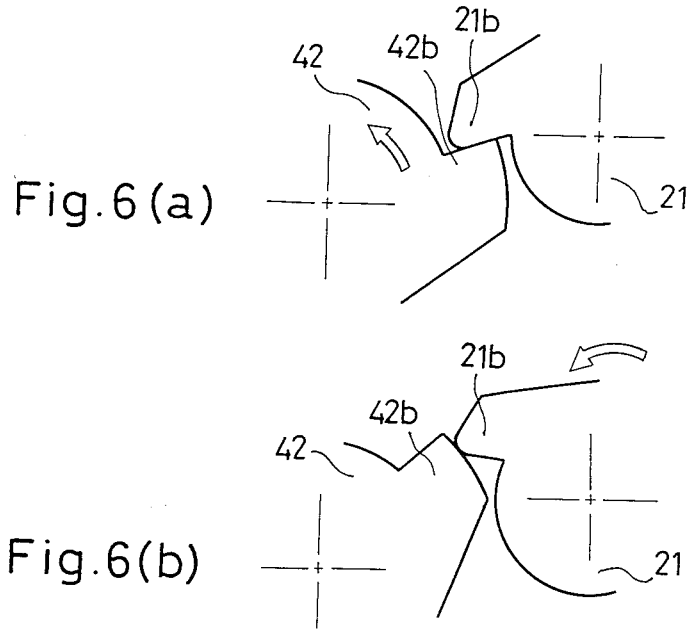
42
42b
21b
21
Fig.6(a)
21b
42b
42
21
Fig.6(b)

SERIAL PRINTER HAVING TWO CARRIAGES CARRYING RESPECTIVE TYPE WHEELS AND MOVABLE INDEPENDENTLY

BACKGROUND OF THE INVENTION

The present invention relates to an impact serial printer of the type which prints by impacting a record medium with type elements.

Recently, in the field of printers, personal and hand held printers suitable for use in printing desk-top electronic calculators and the like have come into increasing use, particularly such printers of a reduced size and weight. As the printer for such calculators, the so-called impact type serial printer has become favored partly because of the clearness of the printed data and partly because the printer may be easily used with ordinary paper. This type of printer, although the size and weight are reduced advantageously, is inferior to conventional large-sized printers in regard to the variety of data that may be printed, because there is a practical limit in the number of type elements that can be formed on the type wheel typically used with such printers.

In order to obviate this shortcoming, U.S. Pat. No. 4,051,942 proposes an improved small-sized serial printer having two type wheels. One of these type wheels is shiftable in the direction of a line to be printed, while the other prints only at the rightmost column position so that printing is conducted by selectively using these two type wheels.

The serial printer disclosed in the above-mentioned patent can have a small size and comparatively simple construction because only one type wheel need to be shiftable along the entire line of printing. However, there still is a limit in the number of type elements because, in order to maintain the small size of the printer as a whole, the outside diameter of the type wheel cannot be increased sufficiently to enable a large number of type elements to be placed around its periphery. For the same reason, this serial printer cannot suitably be used for two-color printing.

SUMMARY OF THE INVENTION

Accordingly, an object of the invention is to provide a serial printer which can obviate the above-described problems of the prior art.

To this end, according to the invention, there is provided a serial printer having two shiftable type wheels adapted to be shifted and used selectively to permit a two-color printing or an increase of the number of type element thereby to diversify the content of the printable data.

The above and other objects, as well as advantageous features of the invention will become clear from the following description of the preferred embodiments taken in conjunction with the accompanying drawings.

BRIEF DESCRIPTION OF THE DRAWINGS

FIG. 5 is a schematic illustration of operation of the first embodiment in relation to the position of a rack;

FIG. 6 is an illustration of a relationship between a change-over lever and the rack;

DESCRIPTION OF THE PREFERRED EMBODIMENT

A first embodiment of the invention will be described hereinunder with reference to FIGS. 1 to 12.

Figure 1:
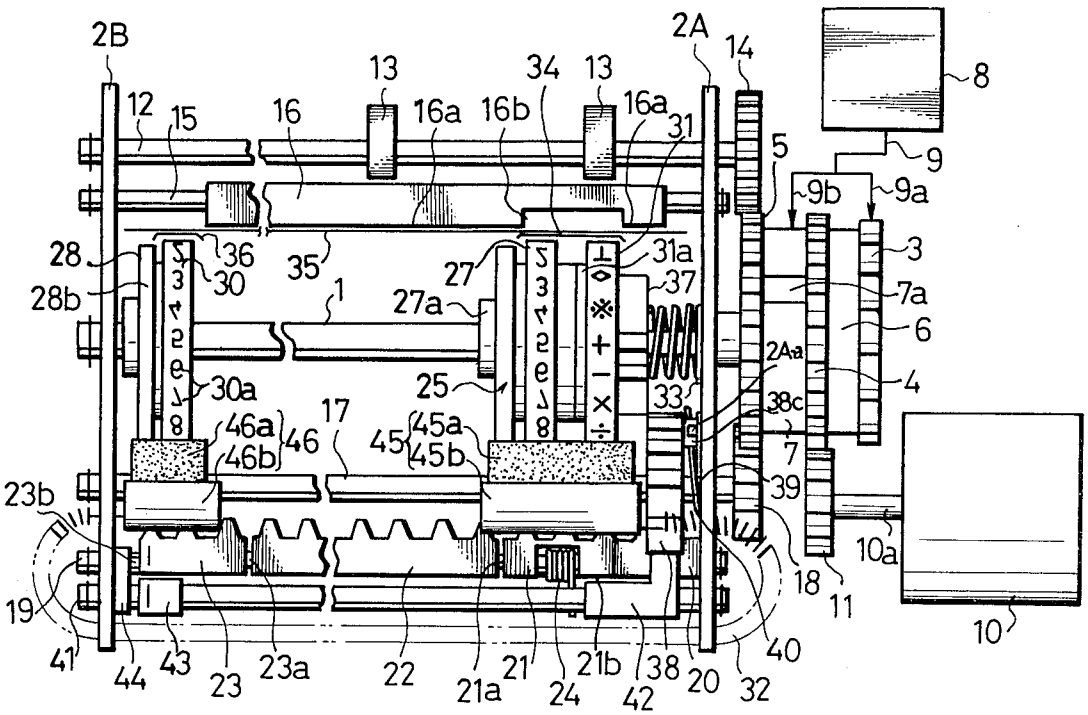
FIG. 1 is a partly simplified plan view of a first embodiment of the invention.

Referring first to FIG. 1, a reference numeral 1 denotes a type wheel shaft rotatably carried by a pair of frame members 2A,2B and having a substantially oval cross-section. As will be clearly understood from FIG. 3, the type wheel shaft 1 has a large-diameter portion 1*a*, small-diameter portion 1*b* and a step portion 1*c* therebetween.

The small-diameter portion 1*b* of the type wheel shaft 1 projects outwardly by a predetermined length from the frame member 2A. A ratchet wheel 3 is fixed to the projected small-diameter portion 1*b*. Gears 4 and 5 are fitted to the same projected small diameter portion 1*b*, and can be independently rotated on the shaft. A reference numeral 6 designates a first clutch on the shaft which is connected between the gear 4 and the ratchet wheel 3, and this first clutch controls the transmission of torque between the ratchet wheel 3 and the gear 4. A second clutch 7 has a peripheral cam groove 7*a* and is disposed between the gears 4 and 5 to control the transmission of torque between these gears.

These clutches 6,7 are adapted to be actuated by an actuating rod 9 adapted to be controlled by a solenoid 8. The actuating rod 9 has one end engageable with the ratchet wheel 3 and the other end engageable with the cam groove 7. The actuating rod 9 operates as a kind of mechanical flip-flop such that, while one end 9*a* engages the ratchet wheel 3, the other end 9*b* is disengaged from the cam groove 7*a*; whereas, while the other end 9*b* is out of engagement with the cam groove 7, the one end 9*b* is held in engagement with the ratchet wheel 3.

When the actuating rod 9 is in engagement with the cam groove 7*a*, the gear 4 and the type wheel shaft 1, i.e. the ratchet wheel 3 are rotatable as a unit, while the driving connection between the gears 4 and 5 is broken. To the contrary, when the actuating rod 9 is in engagement with the ratchet wheel 3, the gears 4 and 5 rotate as a unit with each other, while the gear 4 is disconnected from the type wheel shaft 1.

A unidirectional D.C. motor 10 has an output shaft 10*a* attached to a gear 11 meshing with the gear 4. Thus, the torque of the motor 10 is selectively transmitted by the clutches 6 and 7 to either the type wheel shaft 1 or the gear 5 through the gear 4.

A reference numeral 12 denotes a hammer driving shaft extended between the frame members 2A and 2B. This shaft 12 fixedly carries a gear 14 which engages the gear 5. A reference numeral 15 designates a hammer shaft extended between the frame members 2A and 2B and carries a hammer member 16 having a striking surface 16*a* of a length large enough to cover the entire length of the line that can be printed.

A reference numeral 17 designates a rotary guide shaft having a non-circular cross-section and adapted to drive a carriage which will be mentioned later. The guide shaft 17 is provided at its one end with a gear 18 which meshes with the aforementioned gear 5.

A rack shaft 19 has a non-circular cross-section and is held between the frame members 2A and 2B for rotation through a predetermined angle. The rack shaft 19 is provided with four separate racks. Namely, a relatively short rack 20 is fixedly inserted into the end of the rack shaft 19 so as to rotate therewith at a position adjacent to the frame member 2A. Another short rack 21 is held on the rack shaft 19 so as to be rotated relative thereto at a position close adjacent to the first-mentioned rack 20. A longer rack 22 is fixedly inserted on the rack shaft 19 at a position near the rack 21. Furthermore, a short rack 23 is fixedly inserted on the rack shaft 19 at a portion adjacent to the rack 22, i.e. to the end of the rack shaft 19 adjacent to the frame member 2B.

The racks 21 and 23 are provided with lateral projections 21*a*, 23*a* which are held in contact with the underside of the rack 22. The arrangement is such that, as the rack 22 is rotated downwardly as viewed in FIG. 4, i.e. in the clockwise direction, the racks 21 and 23 are rotated simultaneously. The rack 20 is also rotated as these racks rotate.

Figure 4:
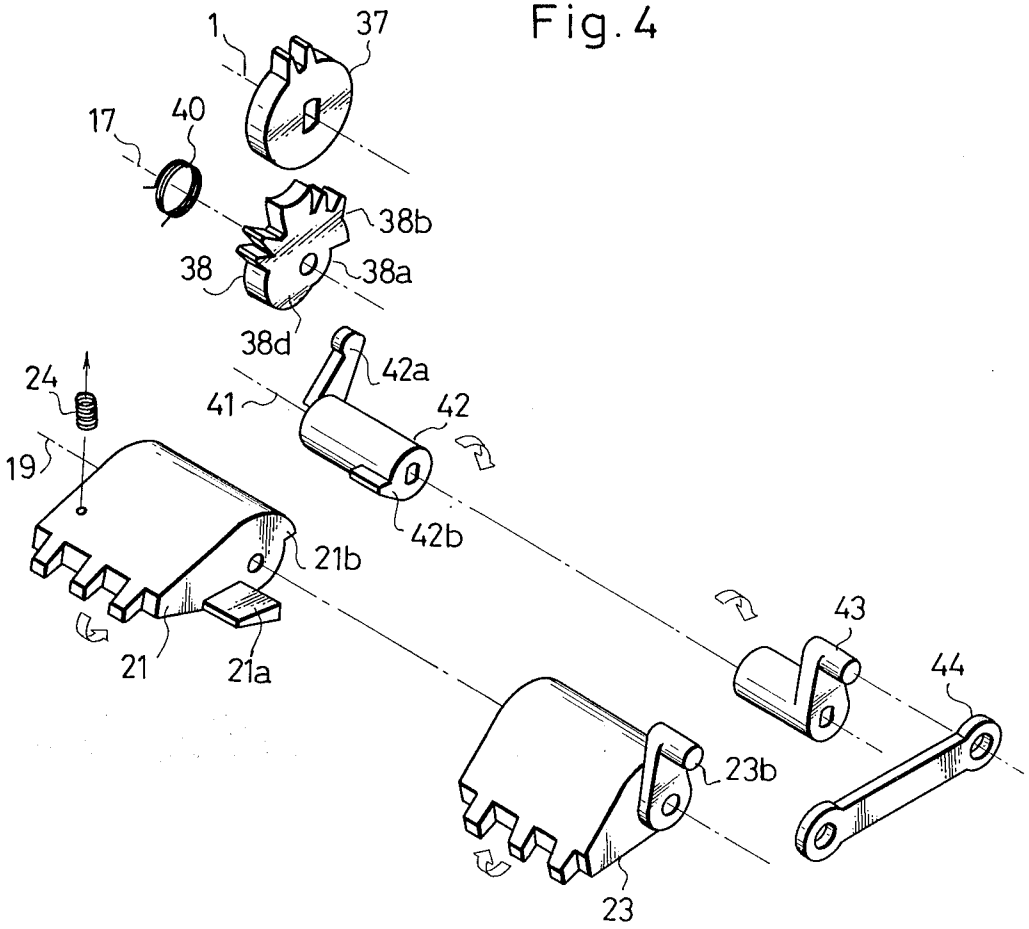
FIG. 4 is a perspective view of a rack change-over mechanism.

As will be clearly seen from FIG. 4, the rack 21 has a projection 21*b* for engaging a later-mentioned lever 42, while the rack 23 is provided with a projection 23*b* for engagement with a later-mentioned lever 43. The rack 21 is normally biased upwardly by a rack spring 24 secured thereto. In FIG. 4, the rack spring 24 is illustrated in a simplified form.

Figure 7:
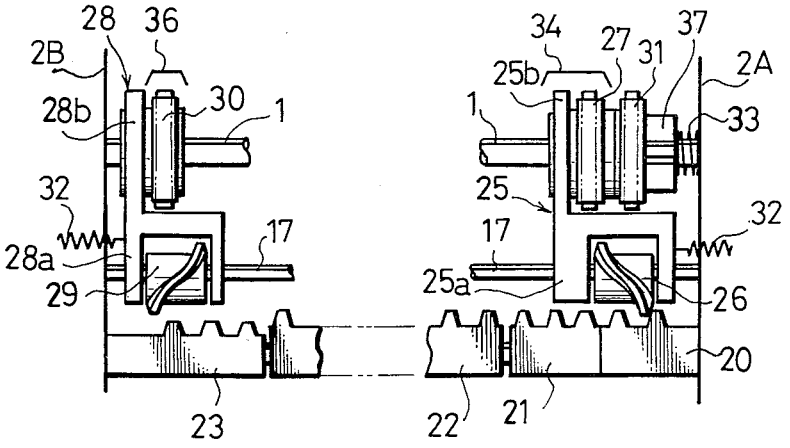
FIGS. 7 to 12 are drawings illustrating the operation of the first embodiment in relation to the shifting of a carriage.

A reference numeral 25 designates a first carriage provided at its base portion 25*a* (See FIG. 2) with a circular hole receiving the aforementioned guide shaft 17 slidably. A first screw member 26 is rotatably held by the base portion 25*a* in such a manner as not to drop downwardly from the latter. The first screw member 26 is splined to the guide shaft 17 so that it is adapted to rotate as a unit with the latter but can slide axially relatively to the same. Racks 20, 21 and 22 mesh with teeth portion of the screw member which extend downwardly from the lower side of the base portion 25*a*. The teeth of the screw member are formed circumferentially over the screw member 26 but spiral over only half of the circumference of the same as shown in FIG. 7. The arrangement is such that the rack 20,21 or 22 comes to engage the spiral teeth portion of the screw member 26 in the later half part of the rotation of the guide shaft 17, so that the first screw member 26 and, hence, the first carriage 25 are shifted to the left as viewed in the drawings by a distance corresponding to one pitch of the column during the later half part of the rotation of the guide shaft 17.

A reference numeral 27 denotes a first type wheel carrying numeric type elements and provided at its center with a substantially oval hole conforming with the cross-section of the large-diameter portion of the type wheel shaft 1 so as to receive the latter and rotate integrally therewith. Thus, the type wheel 27 can slide over the large-diameter portion 1*a* and the small-diameter portion 1*b* of the type wheel shaft 1.

Figure 2:
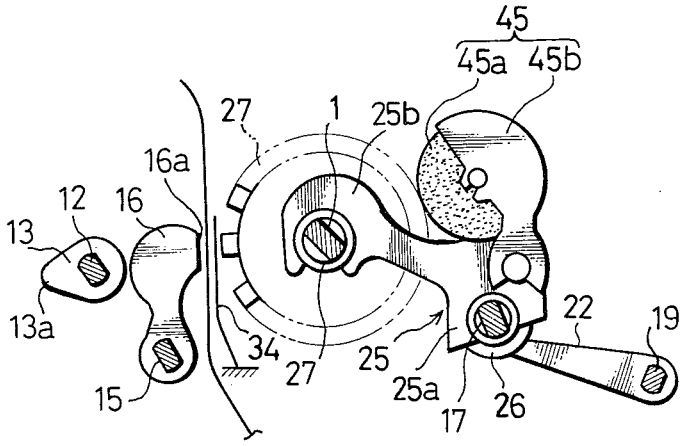
FIG. 2 is a sectional view of essential parts of the embodiment shown in FIG. 1.
Figure 3:
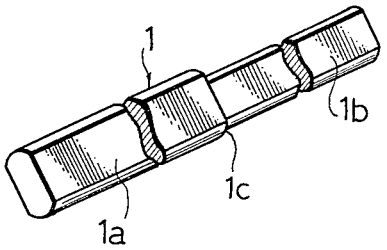
FIG. 3 is a perspective view of shaft for a type wheel.

As shown in FIG. 2, the first type wheel 27 has a hub 27*a* formed on one side thereof and provided with an annular groove which as shown in FIG. 2 is engaged by an arm portion 25*b* of the carriage 25 so as to be shifted together with the carriage 25 while being rotatably held by the latter.

A reference numeral 28 designates a second carriage having essentially the same construction as the first carriage. Namely, the second carriage 28 has a base portion 28*a* (See FIG. 7) having a hole slidably receiving the guide shaft 17 and supports at the base portion 28*a* a second screw member 29 which is splined to the guide shaft 17. As will be seen from FIG. 7, the second screw member 29 has the same shape as the first one 26. Namely, it has the teeth portion extending circumferentially over the outer circumference thereof, but spiralling over only half portion thereof. The spiral teeth portion, however, are orientated in the opposite direction to that of the first screw member. As in the case of the first screw member, the spiral teeth portion comes to engage the rack 23 or 22 during the later half part of rotation of the guide shaft 17 so as to be rotated thereby to shift the second carriage to the right, i.e. in the direction opposite to the shift of the first carriage, by a distance corresponding to one pitch of the column.

A second type wheel 30 carrying numeric type elements is splined to the type wheel shaft 1, as in the case of the first type wheel 27. This second type wheel 30 is shifted together with the second carriage 28 while being held by the latter rotatably. As in the case of the first type wheel, the arm 28*b* of the second carriage 28 engages an annular groove formed on a hub on the second type wheel 30.

A type wheel 31 for function types has a central hole (not shown) of a substantially oval shape conforming with the cross-section of the small-diameter portion 1*b* of the type wheel shaft 1 to receive the latter. Thus, the type wheel 31 rotates as a unit with the type wheel shaft 1 and slides only over the small-diameter portion 1*b* of the type wheel shaft 1.

A reference numeral 32 designates a reset spring for resetting the first carriage 25 and the second carriage 28. Namely, the reset spring 32 is connected at its one end to the first carriage 25 and at its other end to the second carriage 28 to normally bias the first carriage to the right and the second carriage 28 to the left as viewed in FIG. 1, i.e. toward the home positions of respective carriages 25 and 28. As a reset instruction for resetting the first carriage 25 is given, the four racks 20,21,22,23 are rotated to come out of engagement with the first screw member 26 to rapidly reset the first carriage 25 to the home position. Similarly, when an instruction is given for resetting the second carriage 28, the racks are disengaged from the second screw member 29 due to a rotation of the rack shaft 19 to permit the second carriage 28 to be reset rapidly to the home position. A reference numeral 33 designates a spring disposed between the frame member 2A and the type wheel 31 for function type elements to normally bias the latter leftward as viewed in FIG. 1. In the state for preparing for the start of the printing of one line, since the spring 32 has a larger spring constant than the spring 33, the first type wheel 27 presses at its one side surface the hub 31*a* of the function type wheel 31 to shift the latter rightward as viewed in the drawings to take the position opposing to the striking surface 16*a* of the hammer member 16, while positioning the first type wheel 27 opposite a notch 16*b* formed in the hammer member 16. In this stand-by state preparing for the start of printing of one line, the second type wheel 30 is located at a position laterally outward beyond the end of the hammer member 16. FIGS. 1 and 7 show the state in which both carriages 25,28 take their home positions.

The notch 16*b* formed in the hammer member 16 has a width corresponding to two pitches along the line to be painted. A mask 34 made of a resilient thin metallic sheet is positioned across the open area of the notch 16*b*.

The mask 34 has a width substantially equal to the width of the notch 16*b* and prevents any printing by a type wheel located opposite the notch on a printing paper 35 which is placed between the hammer member 16 and the mask 34. When the hammer member 16 operates, the mask 34 moves within the notch 16*b* together with a part of the printing paper 35.

A second mask 36 is adapted to take a position between the second type wheel 30 and the printing paper 35 to prevent any printing on the paper 35, by the second type wheel when the second type wheel 30 takes the home position. Since this second mask 36 takes a substantially equal width to the second type wheel 30, the second type wheel 30 is moved from the position confronting the second mask 36 and comes to face the printing paper 35, as the second carriage 28 is shifted by one pitch.

A reference numeral 37 (See FIG. 4) designates a gear provided at its center with a substantially oval hole substantially conforming with the cross-section of the small-diameter portion 1*b* of the type wheel shaft 1 to rotate as a unit with the latter. The gear 37, in addition, is adapted to be pressed onto the function type wheel 31 to slide on the small-diameter portion 1*b* of the type wheel shaft 1 in accordance with the shift of the type wheel 31. A reference numeral 38 designates a cam gear (driving member) rotatably secured to a shaft 39 attached to the frame member 2A and, as shown in FIG. 4, has a cam portion 38*a* over half its circumference and a gear portion 38B over the other half circumference. The above-mentioned gear portion 38B makes an intermittent gear connection to the gear 37. Namely, the cam gear 38 can make a half or less revolution while the driving gear 37 makes several revolutions. In the state ready for the starting of printing, i.e. when the function type wheel 31 and the gear 37 take the rightmost position as viewed in the drawings, the gear portion 38*b* formed on the half circumference of the cam gear 38 meshes with the gear 37, and the cam gear 38 is rotated at a certain gear ratio to the rotation of the type wheel shaft 1. When the gear 37 has been moved to the left along the type wheel shaft 1 over a distance corresponding to one or more pitches of columns as a result of the leftward shifting of the function type wheel 31, the gear 37 is out of engagement with the cam gear 38 so that the latter is held in the initial position which will be explained later. A reset spring 40 for the cam gear 38 is loosely fitted to the shaft 39 and is retained at its one end by the frame member 2A and at its other end by the cam gear 38 so as to rotationally bias the latter in the direction opposite to the rotation caused by the torque of the gear 37.

In the initial state, a stopper 38*c* projecting laterally from the cam gear 38 is pressed, due to the torque of the reset spring 40, against a stopper projection 2A-*a* formed on the portion of the frame member 2A residing on the locus of rotation of the stopper 38*c*. The cam portion 38*a* of the cam gear 38 has a semi-disc shape on a part of the periphery of which formed is a protrusion 38*d*.

A reference numeral 41 designates an idler shaft having a substantially oval cross-section. Levers 42 and 43 are fixedly fitted around this idler shaft 41, as will be seen from FIGS. 1 and 4. The lever 42 has free end 42*a* contacting the cam portion 38*a* of the cam gear 38 and has a cylindrical base end on is formed a projection 42*b* engaging a projection 21*b* of the rack 21. The lever 43 is coupled to the projection 23*b* of the rack 23 through a crank 44.

Referring back to FIGS. 1 and 2, numerals 45 and 46 designate respective ink supplying means secured to respective carriages 25,28 and adapted to supply type wheels 27,31 and 30 with ink. These ink supplying means include ink rollers 45*a*,46*a* impregnated with ink, ink roller covers 45*b*,46*b* detachably secured to the carriages 25,28 and rotatably carrying the ink rollers 45*b*,46*b*, and springs (not shown) for biasing the ink roller covers 45*b*,46*b* to bring the ink rollers 45*a*,45*b* into resilient contact the respective type wheels.

In the described and illustrated embodiment, the ink roller 45*a* is impregnated with blue ink, while the ink roller 46*a* is impregnated with red ink to permit a two-color printing.

The printer of this embodiment having the described construction operates in a manner explained hereinunder. First of all, it is to be understood that there are two modes of operation of the serial printer of the invention. Namely, in the first mode of operation, a printing is effected by the first numeric type wheel 27 subsequently to the printing by the function type wheel 31, while, in the second mode of operation, a printing is effected by the second numeric type wheel 30 subsequently to a printing by the function type wheel 31. The following description of operation, therefore, will be made mainly on the first mode of operation and the second mode will be explained thereafter mainly in regard to the difference between the two modes. FIGS. 5 to 12 illustrating the operation show the printer only schematically for simplification of the drawings.

In the stand-by state shown in FIG. 7 preparing for the starting of the printing, the function type wheel 31 opposes the striking surface 16*a* of the hammer member 16, while the first and second type wheels 27 and 30 oppose the masks 34 and 36 respectively. The actuating rod 9 of the solenoid 8 is biased by a spring (not shown) into engagement with the cam groove 7*a* of the second clutch 7. In this state, the torque of the motor 10 can be transmitted to the type wheel 1 and the ratchet wheel 3 through the gear 4 and the first clutch 6. In this stand-by state, the four racks 20 to 23 take the positions shown in FIG. 5*b*. Namely, the racks 20, 21 and 22 take positions engageable with the screw member 26 while the rack 23 takes a position not engageable with the screw member 29.

As the motor 10 starts to rotate in this state, the type wheel shaft 1 is rotated as stated before, to rotate the type wheels 27,31 and 30. Ink is applied to the respective type wheels in the first rotation of each type wheel. Then, in the subsequent rotation of the type wheels 27,31 and 30, the solenoid 8 is energized in accordance with the printing instruction, so that the actuating rod 9 comes away from the cam groove 7*a* of the second clutch 7 and is brought into engagement with the ratchet wheel 3, so that the first clutch 6 is turned off to interrupt the rotation between the type wheel shaft 1 and the motor 10.

In consequence, the type wheel shaft 1 stops rotating so that the type wheel 31 is made to stop with the desired type stationed to face the striking surface 16*a* of the hammer member 16.

The energization of the solenoid 8 for selecting the type is made only temporarily. However, as the actuating rod 9 comes away from the cam groove 7*a* of the clutch 7, a direct torque transmission is achieved between the motor 10 and the second clutch 7 and the gear 5, through the gear 4. Therefore, the actuating rod 9 biased toward the second clutch 7 by the spring is brought into pressure contact with the peripheral surface of the second clutch 7, in accordance with the rotation of the latter. Thus, the actuating rod 9 is held in engagement with the ratchet wheel 3 until the actuating rod 9 comes into engagement with the next cam groove 7*a* of the second clutch 7, to keep the first clutch 6 in the off state, i.e. in the state in which no torque is transmitted, while maintaining the second clutch 7 in the on state, i.e. in the state in which the torque is transmitted.

Therefore, the torque of the motor 10 is transmitted to the gear 5 in the state in which the function type wheel 31 is stationed to oppose the striking surface 16*a*, so that the gears 14 and 18 are rotated to drive the hammer driving shaft 12 and the guide shaft 17 in synchronization.

Before the energization of the solenoid 8, only the type wheel shaft 1 is rotating, so that the cam gear 38 is also rotated because its gear portion 38*b* meshes with the gear 37.

As explained before, the type wheel shaft 1 is stopped by the operation of the clutch means after less than one rotation for positioning the desired type of the function type wheel 31 to face the striking surface of the hammer member 16 subsequently to one full rotation for applying ink to the types formed on the peripheries of the type wheels 27,31 and 30. Therefore, in the ordinary type selecting operation, the number of rotations of the type wheel 1 is maintained below a predetermined number. In addition, the number of rotations of the type wheel shaft 1 is also limited below a predetermined number. Therefore, there is an upper limit for the rotation angle of the gear 38 in accordance with the gear ratio between the gear 37 and the gear portion 38*b* of the cam gear 38.

In the stand-by state preparing for the start of the printing, the free end 42*a* of the lever 42 is held in contact with the portion other than the protrusion 38*d* on the cam portion 38*a* of the cam gear 38. Therefore, if the rotation angle of the cam gear 38 before bringing the end 42*a* of the lever 42 into engagement with the protrusion 38*d* of the cam gear 38 is selected to be greater than the aforementioned upper limit for the rotation angle, no contact between the end 42*a* of the lever 42 and the protrusion 38*d* of the cam gear 38 takes place in the operation explained heretofore. Therefore, neither lever 42 nor the lever 43 connected through the idler shaft 41 rotates so that the racks 21 and 23 which are driven by the levers 42,43 are kept in the state shown in FIG. 5*a*.

As the type wheel shaft 1 stops to rotate and the hammer driving shaft 12 starts to rotate as a result of the switching of the clutch means, the projection 13*a* (See FIG. 2) of the hammer driving cam 13 presses the back side of the hammer member 16 in the earlier half part of the rotation of the hammer driving shaft 12 thereby to rotate the hammer member 16 around the axis of the hammer axis 15. In consequence, the striking surface 16*a* of the hammer member 16 is pressed onto the type wheel 31 through the medium of the printing paper 35 interposed therebetween as shown in FIG. 2, thereby printing the desired character in the rightmost column position of the printing paper 35. Meanwhile, the guide shaft 17 rotates in synchronization with the rotation of the hammer driving shaft 12. In the earlier half part of the rotation of the guide shaft 17, however, the spiral teeth portion of the first screw member 26 does not mesh with the rack 20. In the later half part of the rotation after the completion of the striking rotation of the hammer member 16, the the spiral teeth portion of the first screw member 26 comes into engagement with the rack 20, so that the first carriage 25 is shifted by one pitch of column to the position shown in FIG. 8, overcoming the force of the spring 32. On the other hand, the hammer member 16 is automatically reset to the non-printing position by the action of a reset spring not shown.

Figure 8:
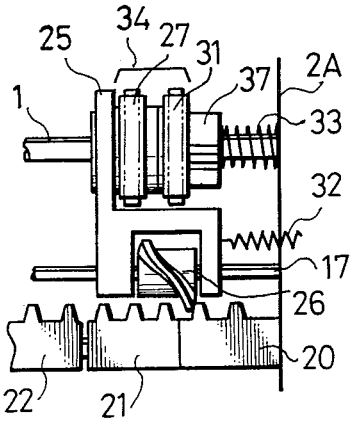

As a result of the shifting of the first carriage 25, the function type wheel 31 is shifted to the left as viewed in the drawings by the pressure of the spring 33, i.e. from the position shown in FIG. 7 to the position shown in FIG. 8. As a result of the shifting of the function type wheel 31, the gear 37 is moved to the left so that the gear 37 is disengaged from the gear portion 38*b* of the cam gear 38, and the cam gear 38 is rotated by the force of the reset spring 40 until the stopper 38*c* thereof is stopped by the projection 2A-a of the frame member 2A, i.e. to the initial position.

On the other hand, no column shift of the second carriage 28 and the second type wheel 30 carried by the latter is effected because the second screw member 29 is out of engagement with the rack 23.

As the driving of the hammer member 16 and the column-shift of the first carriage 25 are completed, i.e. after one full rotation of the hammer driving shaft 12 and the guide shaft 7, the second clutch 7 making synchronous rotation therewith achieves a half rotation, so that the cam groove 7*a* of the second clutch 7 is moved to the position facing the actuating rod 9 so that the latter drops into the cam groove 7*a* and comes off away the ratchet 3 to turn on the first clutch 6 while turning the second clutch 7 off.

In consequence, the rotation of the motor 10 is transmitted only to the type wheel shaft 1 to resume the state in which the type wheels 27,31 and 30 are rotated.

In the state shown in FIG. 8 in which the first carriage 25 has been moved by one pitch, the function type wheel 31 has been moved from the rightmost column position by one pitch to the upper place to take the position facing the first mask 34. On the other hand, the other type wheel 27 still takes the position confronting the first mask 34.

The second type wheel 30 also remains in the position facing the second mask 36. The solenoid 8 is energized in accordance with the printing instruction to effect again a series of operations including the selection of the type, driving of the hammer member 16 and the shift of the carriage 25 by one pitch.

In this state, all of the three type wheels 27,31 and 30 oppose to the masks 34 and 37, so that no printing is effected on the printing paper 35 but the column-shift of the first carriage 25 is effected. Then, as the carriage 25 is shifted from the position shown in FIG. 8 to the position shown in FIG. 9, the first type wheel 27 is moved out of the position facing the first mask 34 to the position opposing the striking surface 16*a* of the hammer member 16.

Simultaneously, as a result of the leftward movement of the first carriage 25, the function type wheel 31 pressed by the spring 33 is shifted, so that the cylindrical portion 31*a* (See FIG. 1) of the type wheel 31 comes into contact with the step 1*c* of the type wheel shaft 1 and is prevented from any to further movement leftwardly. In consequence, the type wheel 31 remains in a position facing the mask 34.

Figure 9:
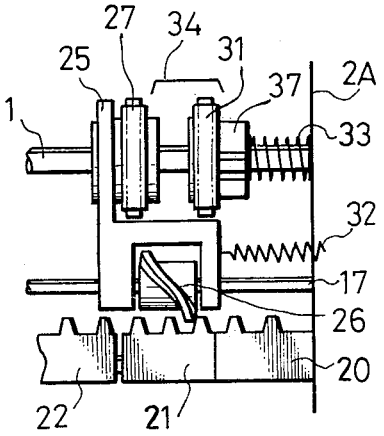

In this column-shift operation, as shown in FIG. 9, the first screw member 26 held by the first carriage 25 comes out of engagement with the rack 20 and comes into engagement with the rack 21. Thereafter, the first type wheel 27 solely is shifted by the engagement of the first screw member 26 with the rack 21 and then with the rack 22, so that numerals are printed on the printing paper 35 in a line successively from the rightmost column position.

Then, as the printing of one line is over, the rack shaft 19 is rotated by a suitable means such as an electromagnetic solenoid so as to rotate the racks 20 and 22 unitary with the rack shaft 19. In consequence, due to the engagement between the rack 22 and the projection 21*a* of the rack 21, the latter is rotated and all racks come to take the positions shown in FIG. 5*a*. In consequence, the rack engaged with the first screw member 26 is disengaged therefrom and the first carriage 25 is rapidly reset to the home position by the tension of the spring 32. Then, after the resetting of the first carriage 25 to the home position, the rack shaft 19 is rotated in the resetting direction due to the force of a spring (not shown) as the rack shaft 19 is relieved from the rotational biasing force, and is reset at the initial position where it is stopped by a stopper which is not shown. In consequence, the racks 20,22 and the rack 21 are reset together with the rack shaft 19 where they can engage the screw members by the force of the spring 24, as in the state shown in FIG. 5(*a*) or in the state shown in FIG. 7 ready for the start of printing of a new line.

The first mode of operation in which the printing is effected by the first type wheel 27 subsequently to the printing by the function type wheel has been described. The second mode of operation in which the printing is made at first by the function type wheel and then by the second type wheel will be explained hereinunder.

As in the case of the first mode of operation, a printing is effected from the printing stand-by position shown in FIG. 7 by the function type wheel 31.

To this end, a series of operations is conducted to complete the selection of the type, driving of the hammer member 16 and the shift of the first carriage 25 over a distance corresponding to one pitch of columns. In the selection of the type, the type shaft wheel 1 makes several rotations, e.g. two rotations, instead of the less than one rotation stated earlier.

Namely, the minimum rotation number of the type wheel shaft 1 is selected to be greater in the second mode of operation than in the first mode of operation, when the printing is commenced from the state in which the types 27,30 and 31 take their home positions.

Therefore, the rotation angle of the cam gear 38 engaging the gear 37 on the type wheel shaft 1 is selected to be always greater in this second mode of operation than in the first mode of operation. In consequence, the free end 42*a* of the lever 42 is allowed to make a pressure contact with the protrusion 38*d* of the cam gear 38 to cause a rotation of the lever 42 the lever 43 in the direction indicated by arrows in FIG. 4.

The rack 21 is depressed against the force of the spring 24 by the rotation of the lever 42 and comes to take a position where it cannot engage the first screw member 26. At the same time, the rack 23 is pushed upward by the rotation of the lever 43 through the action of the crank 44 to the position engageable with the second screw member 29. Namely, the rack 23 and the associated members take the positions shown in FIG. 5*c* and FIG. 10.

In effecting the column-shift after the completion of the printing by the function type wheel 31, the gear 37 comes out of engagement with the cam gear 38 so that the latter is moved back to the initial position by the force of the spring 40 to disengage the protrusion 38*d* thereof from the free end 42*a* of the lever 42 projecting from the rack member 20. However, after the driving of the projection 21*b* of the rack 21 by the projection 42*b* of the lever 42 (See FIG. 6*b*), the projection 42*b* of the lever 42 and the projection 21*b* of rack 21 take the positional relationship as shown in FIG. 6*b*. This positional relationship is maintained although the rack 21 tends to be returned to the position shown in FIG. 6*b* by the force of the spring 24 acting in the direction of arrow in FIG. 6*b*, because the lever 42 is prevented from being rotated.

Figure 10:
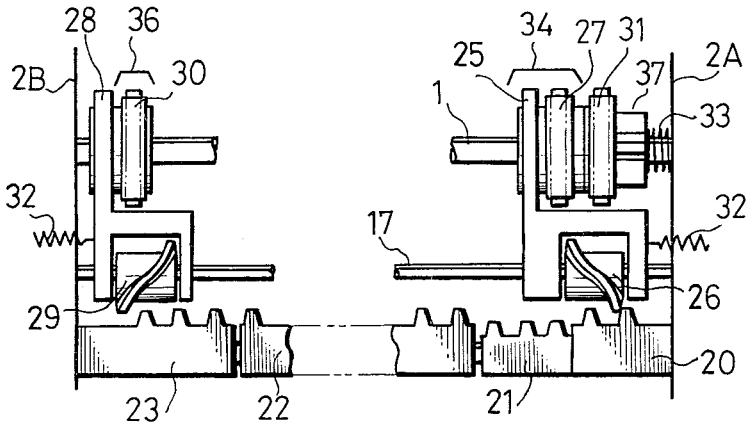
Figure 11:
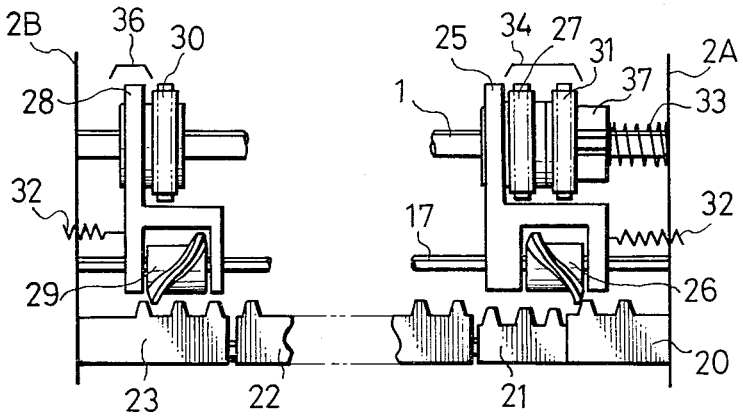

As has been described, since the first column-shift is effected from the positions shown in FIG. 5*c* and FIG. 10, the shifting of the first carriage 25 and the shifting of the second carriage 28 toward each other are effected simultaneously in the first column-shift operation as will be understood from FIG. 11, so that the second type wheel 30 is moved away from the position facing the mask 36 to the position confronting the striking surface 16*a* of the hammer member 16.

In the next series of operations including the type selection, driving of the hammer member 16 and the column-shift in accordance with the subsequent printing instruction, the printing is effected solely by the second type wheel 30 at the leftmost column position, because first screw member 26 cannot engage the rack 21 and the function type wheel 31 and the first type wheel 27 are thus held behind the first mask 34. Then, in the subsequent column-shift operation, the second carriage 28 is moved from the leftmost column position to a more rightward column position by a distance corresponding to one pitch of the column, due the the engagement between the rack 23 and the second screw member 29.

Figure 12:
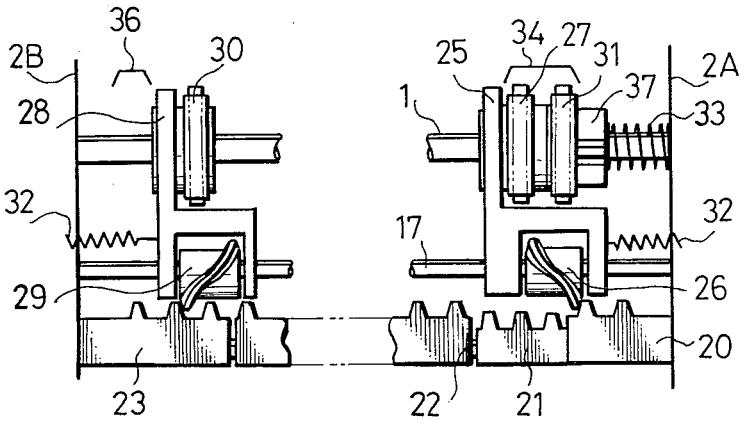

On the other hand, since the rack 21 is spaced from the first screw member 26 due to rotation of the rack 21 as shown in FIG. 12 or FIG. 5*c*, there is no driving connection between the screw member 26 and the rack 21, so that the first screw 26 and, hence, the first carriage 25 are never moved leftward from the position shown in FIG. 12 but are held at the position where the first screw member 26 engages the rack 20, i.e. at the position where the function type wheel 31 and the first type wheel 27 face the first mask 34 as shown in FIG. 12.

Thereafter, a series of operations including the selection of type, driving of the hammer member 26 and the column shift is effected as explained before so that the second screw member 29 is moved out of engagement with the rack 23 into engagement with the rack 22 and the screw member 29, i.e. the second carriage 28, is moved along the rack 22. In consequence, printing is made by the desired types of the second type wheel 30 successively from the upper column position to the lower column position, i.e. from the left position to the right position. Since the second type wheel 30 is applied with an ink of a color different from that of the ink applied to the first type wheel 27, the data printed by the second type wheel 30 has a color different from the data printed by the first type wheel 27 so as to be distinguished easily from the latter.

After the completion of printing of one line, the rack shaft 19 is rotated by suitable electromagnetic means or the like as in the case of the first mode of operation, thereby to rotate the racks 20 and 22 integral with the rack shaft 19. In consequence, the rack 23 having a projection 23*a* engaging the rack 22 is rotated so that all racks are disengaged from the screw members 26 and 29 as shown in FIG. 5*a*, thereby to permit the second screw member 29, i.e. second carriage 28 and the first screw member 26, i.e. the first carriage 25, to be returned rapidly to their home positions. As a result of the rack 23, the lever 43 coupled to the rack 23 through a crank is also rotated so that the lever 42 is rotated together with the idler shaft 41 in the direction opposite to the direction of the arrow in FIG. 4 to release the rack 21 from the locked state shown in FIG. 6*b*.

Subsequently, the rack shaft 19 is reset to the initial state so that the printer as a whole takes the stand-by position preparing for the printing of a new line as shown in FIG. 7.

Thereafter, by suitably controlling the rotation speed of the type wheel shaft 1 at the home position, the printing of successive lines is effected by the first and second type wheels 24 and 27 selectively.

The printing by the second type wheel 30 is effected from the upper column position, i.e. from the left position to the right position in each line. In the case where the printing is unnecessary in the upper column position, the printing is effected on such a column position with a blank portion (portion having no type) of the second type wheel 30 opposing to the striking surface 16*a* of the hammer member 16.

The serial printer of the described embodiment is adapted to make a two color printing. This, however, is not exclusive and the serial printer of the invention cam be used for a mono-color printing. In such a case, it is advisable to form types of comparatively fewer chances of use, e.g. symbols such as sin, cos or the like, alphabet symbols, fractional symbols or the like, instead of the ordinary numeric characters on the type wheel 30. By so doing, it is possible to remarkably diversify the printable data.

In the described embodiment of the invention , the switching of the rotational positions between the short racks 21 and 23 is effected by selecting and controlling the rotation number of the type wheel shaft 1 when the first carriage 25 takes its home position.

Figure 13:
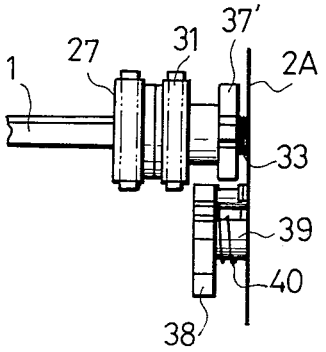
FIGS. 13 and 14 are illustrations of operation of different embodiments, showing particularly the relationship between a cam gear and a gear.
Figure 14:
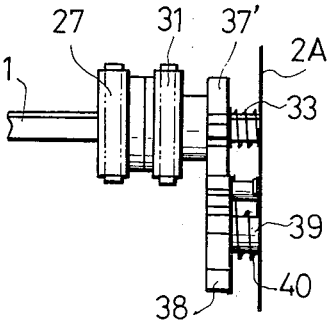

This arrangement, however, is not exclusive and may be substituted by an arrangement as shown in FIGS. 13 and 14. Namely, in the arrangement shown in FIGS. 13 and 14, the gear 37' is allowed to engage with the cam gear 38 only when the first carriage 25 has been moved by a distance corresponding to one pitch of columns, i.e. only after the type wheel 31 and the gear 37 are shifted by one pitch of columns, and the rotation number of the gear 37' is selected and controlled in this state to effect the selection of the switching between the racks 21 and 23 to make the selection as to which one of the first and the second carriages 25 and 28 is to be shifted.

As has been described, according to the invention, it is possible to selectively shift two shiftable type wheels and to effect the printing of each line with these two shiftable type wheels. This advantageously permits a two-color printing in a small-sized impact type serial printer which inherently has a simple construction. It is also possible to increase the number of kinds of types on a single printer to a great advantage in this field of industry.

In addition, since the selective shifting of the carriages is made by rotation of the racks, the construction as a whole is simplified and the operation is smoothed conveniently.

What is claimed is:

1. In a serial printer of the type having a carriage carrying a type head and adapted to be shifted along a line to be printed by cooperation between a rotatable rack and a screw member, the improvement comprising: a rotary shaft adapted to be driven by a suitable driving source; a first screw member and a second screw member splined to said rotary shaft; a first carriage and a second carriage carrying said first screw member and second screw member, respectively, said first and second carriages having respective home positions defined at respective end portions of the line to be printed; spiral screw portions formed on said first and second screw members, respectively, and orientated in the opposite directions; and said rack being formed by short racks positioned at respective axial end portions of a line to be printed and each adapted to be rotated into a position engaging a respective one of said screw members when the respective carriage is at its home position and an intermediate long rack extending between said short racks; and selection means for bringing either of said first and second screw members into selective engagement with said long rack by positioning the respective short rack into engagement with the selected screw member.

2. A serial printer as claimed in claim 1, said selection means including interlocking means for preventing, when one of said short racks takes a position engageable with its associated screw member, the other of said short racks from engaging the other of said screw members.

3. A serial printer as claimed in claim 2, wherein said first and second carriages carry respective type wheels which are applied with inks of different colors.

4. A serial printer as claimed in claim 2, wherein said selection means includes a gear means for transmitting power from said driving source only when said first carraige takes a predetemined column position.

5. A serial printer as claimed in claim 2, including a third type wheel interposed between said first carriage and a lateral frame member of said printer, said third wheel being provided with a sliding means for enabling said third wheel to be shifted one column space along a line to be printed when said first carriage leaves said home position.

6. A serial printer as claimed in claim 5, further comprising a third short rack adjacent to said short rack adapted to be engaged with said first carriage at its home position, said first screw member being engageable also with said third short rack, and means positioning said third type wheel in a position adjacent the region where said first screw member engages said third short rack.

7. A serial printer for printing along a line, including a first carriage carrying a first type wheel having type elements for printing symbols at one end portion of said line and a second type wheel having type elements for printing symbols along remaining positions of said line, said first carriage having a home position at said one end portion of said line; a second carriage having a home position at the other end portion of said line and carrying a third type wheel having type elements for printing symbols along said remaining portions of said line; and means for selectively moving either one of said first and said second carriages along said line for printing symbols corresponding to type elements of either one of said second type wheel and said third type wheel along said remaining portions of said line, said moving means including a respective screw member having a tooth extending spirally along at least part of the circumference thereof and carried rotatably by each of said first and second carriages, a common rotary shaft extending through each of said screw members, and a rack member extending parallel to said common shaft and adapted to engage the spiral teeth of said screw members, said rack member being divided into a plurality of rack segments and means for moving said rack segments selectively out of engagement with said first and second screw members.

8. A serial printer according to claim 7, further including means for holding said first type wheel in a position adjacent said one end portion of said line as said first carriage is moved along said remaining positions of said line.

9. A serial printer according to claim 7, said rack segments including a first relatively short rack segment adapted to engage the teeth of said screw member of said first carriage when said first carriage is in its home position at said one end portion of said line, a second relatively short rack segment adjacent to said first relatively short rack member and adapted to engage the teeth of said screw member of said first carriage when said first carriage is in said position adjacent said one end portion of said line, a third relatively short rack segment adapted to engage the teeth of the screw member carried by said second carriage when it is in its home position at said other end portion of said line, a relatively longer rack segment extending between said second and third rack segments and adapted to engage the screw member of either of said carriages, and means for holding said third relatively short segment out of engagement with the screw member of said second carriage when said first carriage is to be moved along said line and to hold said second relatively short rack segment out of engagement with said screw member of said first carriage when said second carriage is to be moved along said line, whereby said carriages can be moved by rotating said common shaft.

* * * * *